US007614322B1

(12) United States Patent
Corredor-Londoño

(10) Patent No.: US 7,614,322 B1
(45) Date of Patent: Nov. 10, 2009

(54) OPENER APPARATUS FOR A PLURALITY OF DIFFERENT CONTAINERS

(76) Inventor: Pablo Enrique Corredor-Londoño, 1585 E. 11 Ave., Hialeah, FL (US) 33010

( * ) Notice: Subject to any disclaimer, the term of this patent is extended or adjusted under 35 U.S.C. 154(b) by 0 days.

(21) Appl. No.: 12/201,870

(22) Filed: Aug. 29, 2008

(51) Int. Cl.
*B67B 7/44* (2006.01)
*B67B 7/16* (2006.01)

(52) U.S. Cl. ..... 81/3.09; 81/3.55; 81/3.36; 81/3.45

(58) Field of Classification Search ..... 81/3.09, 81/3.36, 3.29, 3.39, 3.45, 3.47, 3.48, 3.35, 81/3.55, 3.57; D8/33, 34, 38, 40, 42, 43
See application file for complete search history.

(56) References Cited

U.S. PATENT DOCUMENTS

D114,211 S * 4/1939 Francke ..... D8/39
4,607,407 A * 8/1986 Bergmeister ..... 7/156
4,759,238 A * 7/1988 Farfalli ..... 81/3.09
D437,538 S * 2/2001 Corredor et al. ..... D8/38
6,327,936 B1 * 12/2001 Eguren ..... 81/3.47
D498,997 S 11/2004 Corredor et al.
6,957,599 B2 10/2005 Corredor et al.

FOREIGN PATENT DOCUMENTS

FR 2689115 AL * 10/1993

* cited by examiner

*Primary Examiner*—Hadi Shakeri
(74) *Attorney, Agent, or Firm*—Albert Bordas, P.A.

(57) ABSTRACT

An opener apparatus comprising a base plate, an elongated housing assembly, a frame assembly, a trigger assembly, a lever arm assembly, and a corkscrew assembly. The base plate has first and second front edges and first and second interior lateral edges extending respectively therefrom to an intermediate edge, first and second wedges extend a first predetermined distance from the first and second front edges respectively. The elongated housing assembly has first and second ends. The elongated housing assembly defines an elongated channel when mounted onto the base plate. The frame assembly is mounted onto a first interior face of the elongated housing assembly. The trigger assembly is pivotally mounted onto the frame assembly. The trigger assembly comprises a trigger, a catch arm having a first lip, a second lip, and a leaf spring. The lever arm assembly and the corkscrew assembly are also pivotally mounted onto the frame assembly.

16 Claims, 7 Drawing Sheets

OPENER APPARATUS FOR A PLURALITY OF DIFFERENT CONTAINERS

BACKGROUND OF THE INVENTION

1. Field of the Invention

The present invention relates to an apparatus to open containers, and more particularly, to an opener apparatus for a plurality of different containers.

2. Description of the Related Art

Corkscrews, bottle and can openers of various types have been known for many years and long have been included in multipurpose tools. However, none of them include the specific features of the present invention.

Applicant believes that one of the closest references corresponds to Applicant's own U.S. Pat. No. 6,957,599 published on Oct. 25, 2005 to Pablo E. Corredor et al., for a beverage bottle and can opener. However, it differs from the present invention, because Corredor et al. teaches a beverage bottle and can opener apparatus comprising an elongated body with a rear flat and raised bottle-shaped front surfaces, including first, second, and third opener devices. The first opener device has a first cavity with engagement edges for receiving a crimped-top cap of a beverage bottle therein in a force-fit arrangement. The second opener device is housed inside a longitudinal storage recess and includes a rotatable spiral corkscrew member and an elongated lever member, both extending longitudinally and perpendicularly from their respective shafts and mounted for axial movement from folded to extending positions for drawing a cork from a beverage bottle. The third opener device includes a second cavity having a rectangular notch being configured to receive a tap-top tab of a beverage can therein. The flat rear surface further has a magnet rigidly mounted thereto to permit the opener apparatus to be held to a metallic surface when it is not in use.

Applicant believes that another reference corresponds to Applicant's own U.S. Design Pat. No. D498,997 issued to Pablo E. Corredor et al., on Nov. 30, 2004 for a beverage bottle and can opener. However, it differs from the present invention, because this patented design does not include features of the present invention.

Applicant believes that another reference corresponds to Applicant's own U.S. Design Pat. No. D437,538 issued to Pablo E. Corredor et al., on Feb. 13, 2001 for an opener for container. However, it differs from the present invention, because this patented design does not include features of the present invention.

Other patents describing the closest subject matter provide for a number of more or less complicated features that fail to solve the problem in an efficient and economical way. None of these patents suggest the novel features of the present invention.

SUMMARY OF THE INVENTION

The instant invention is an opener apparatus for a plurality of different containers, comprising a base plate, an elongated housing assembly, a frame assembly, a trigger assembly, a lever arm assembly, and a corkscrew assembly.

The base plate has first and second front edges and first and second interior lateral edges extending respectively therefrom to an intermediate edge. The base plate comprises first and second wedges extending a first predetermined distance from the first and second front edges respectively. The base plate further comprises at least one semi-circular section having jagged edges.

The elongated housing assembly has first and second ends, and defines an elongated channel extending from the first end a second predetermined distance without reaching the second end, when mounted onto the base plate.

The frame assembly is mounted onto a first interior face of the elongated housing assembly and comprises first and second arms.

The trigger assembly is pivotally mounted onto the frame assembly. The trigger assembly comprises a trigger, a catch arm having a first lip, a second lip, and a leaf spring.

The elongated housing assembly comprises a first aperture, and the trigger protrudes through it. The elongated housing assembly comprises a second interior face, and the leaf spring causes the first lip to be biased against it.

The lever arm assembly is also pivotally mounted onto the frame assembly. The lever arm assembly comprises first and second lever arms. The first lever arm is pivotally mounted onto the second lever arm. The first lever arm comprises a first lip rest, and the second lever arm comprises a second lip rest.

The corkscrew assembly comprises an elongated torso having a hole, and a corkscrew. The corkscrew assembly is also pivotally mounted onto the frame assembly.

The base plate comprises third and fourth ends. The first and second front edges are positioned at the third end, and the base plate further comprises a second aperture positioned in between the third and fourth ends. The base plate further comprises a protrusion positioned at the fourth end.

It is therefore one of the main objects of the present invention to provide an opener apparatus for a plurality of different containers.

It is another object of this invention to provide an opener apparatus for a plurality of different containers that is easy to use and manipulate.

It is another object of this invention to provide such an opener apparatus that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
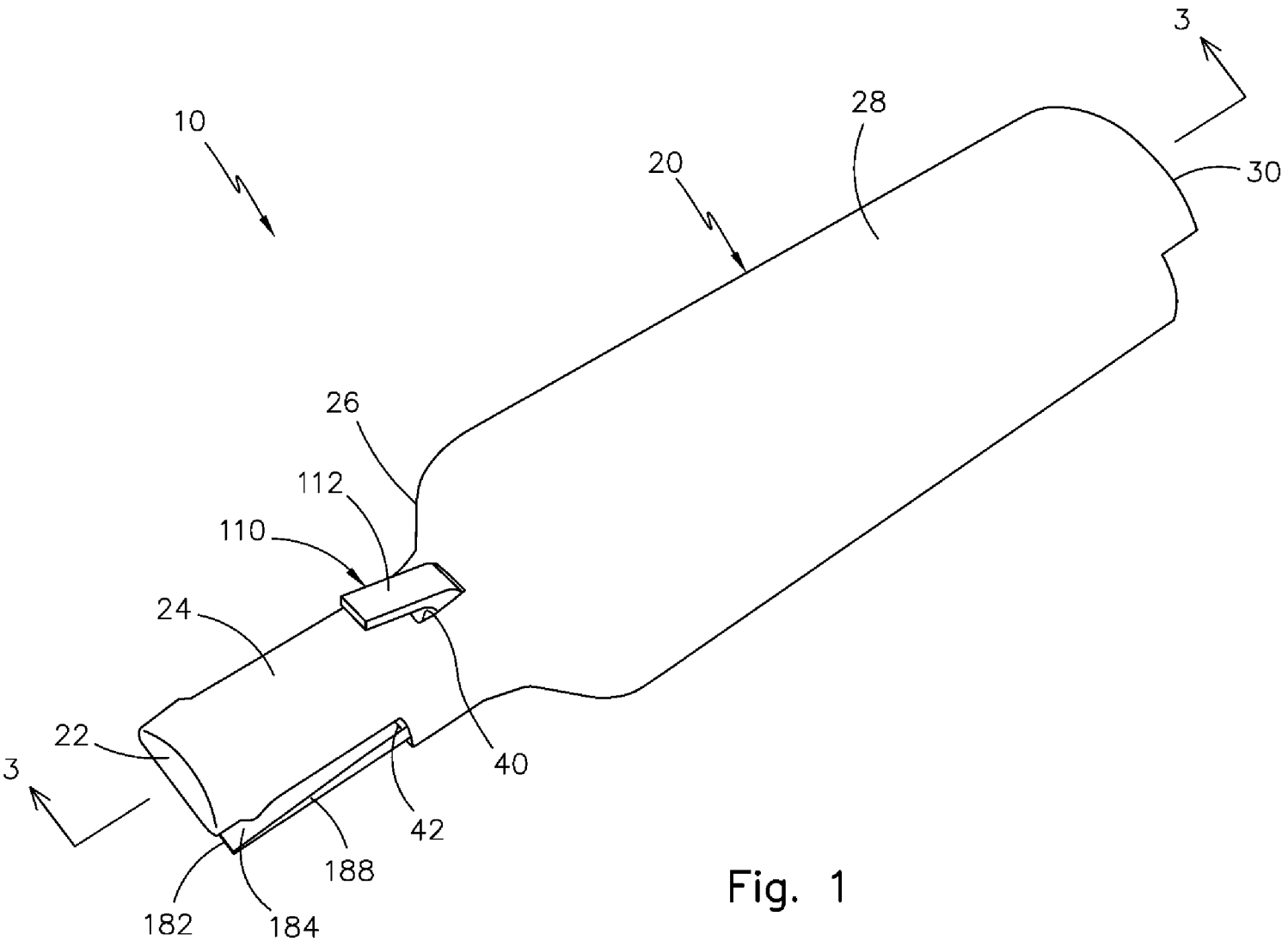
FIG. 1 is an isometric view of the instant invention.

Referring now to the drawings, the present invention is generally referred to with numeral 10. It can be observed that it basically includes housing assembly 20, frame assembly 60, corkscrew assembly 90, trigger assembly 110, lever arm assembly 140, and base plate 180.

Figure 2:
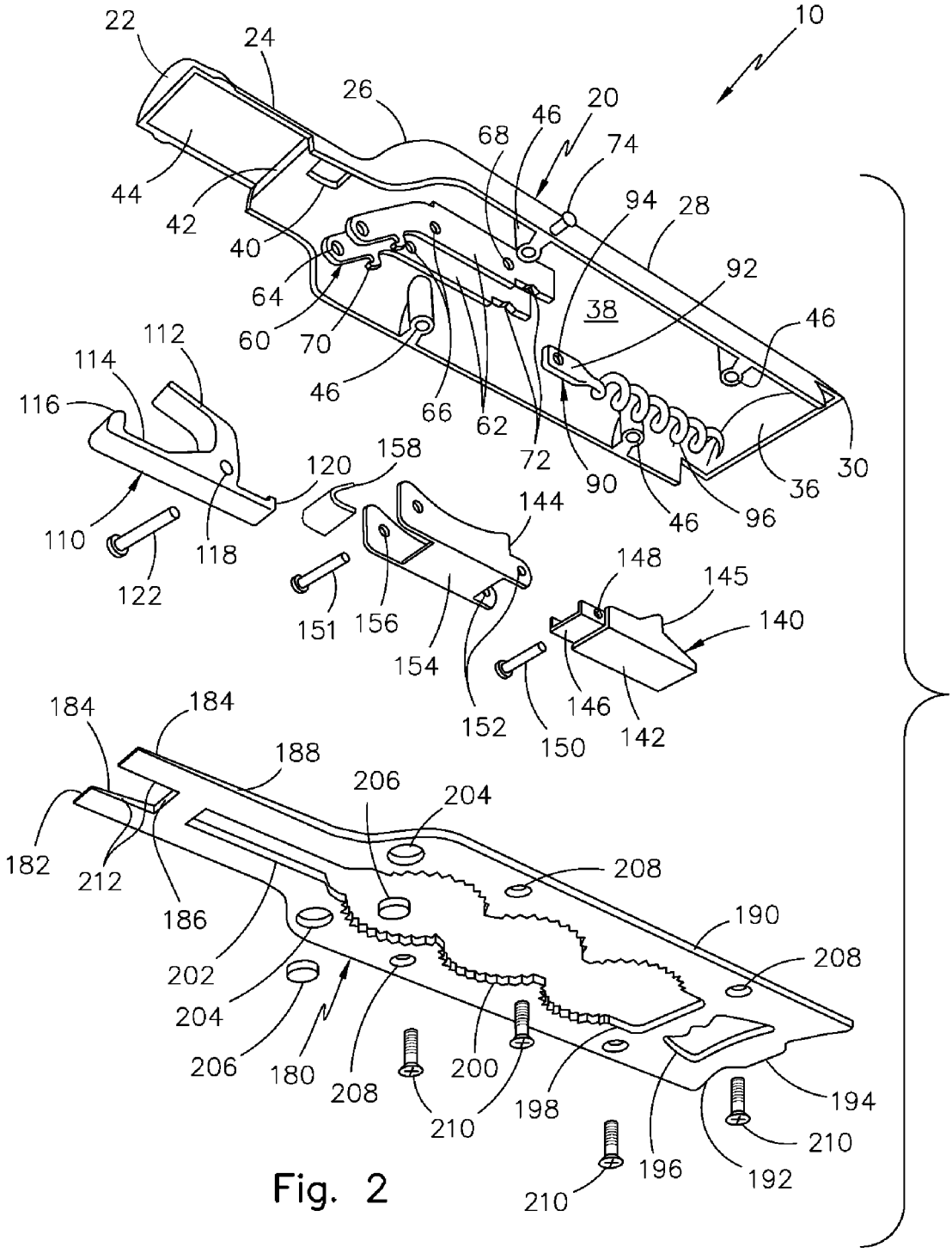
FIG. 2 is an exploded view of the instant invention.

As seen in FIGS. 1 and 2, housing assembly 20 is generally in the shape of a bottle for ornamental purposes and comprises front end 22, exterior neck 24, shoulder 26, exterior body 28, rear end 30 and aperture 40, as seen in its exterior side. Housing assembly 20 also comprises intermediate end 36, interior face 38, intermediate end 42, interior neck 44, and posts 46 as seen in its interior side. In the preferred embodiment, exterior neck 24, shoulder 26, and exterior body 28 have a raised bottle shape and is intended for decorative purposes, when instant invention 10 is not in use and it is mounted onto a magnetic surface such that of a refrigerator with magnets 206.

As best seen in FIG. 2, frame assembly 60 is mounted onto interior face 38 of housing assembly 20. Frame assembly 60 comprises arms 62 that are substantially parallel and equally spaced apart, holes 64, holes 66, holes 68, protrusions 70, cutouts 72, and pin 74. Holes 64 are disposed in an angled portion of arms 62. Holes 66 and 68 are disposed in each arm 62. Each arm 62 comprises cutout 72 at its lower edge.

Corkscrew assembly 90 comprises torso 92, hole 94, and corkscrew 96.

Trigger assembly 110 comprises trigger 112, catch arm 114, lip 116, hole 118, lip 120, pin 122, and leaf spring 158. It is noted that leaf spring 158 is secured in place by lip 120 and protrusions 70. Catch arm 114 has lip 116. Trigger assembly 110 is pivotally mounted onto frame assembly 60 with pin 122 inserted into hole 118 and holes 64. Leaf spring 158 causes lip 116, to bias against interior neck 44.

Lever arm assembly 140 includes lever arms 142 and 154. Lever arm 142 has lip rest 145, and insert 146 with holes 148. Lever arm 154 has lip rest 144, and holes 152 and 156. Lever arm 142 is pivotally mounted onto lever arm 154 with pin 150 inserted into holes 148 and 152. Lever arm 154 is pivotally mounted to frame assembly 60 with pin 151 inserted into holes 156 and 66.

Base plate 180 is also in the shape of a bottle to complement housing assembly 20, and comprises front edges 182, interior lateral edges 212, wedges 184, intermediate edge 186, neck edge 188, body edge 190, rear edge 192, protrusion 194, aperture 196, cutout 198, jagged edges 200, elongated channel 202, holes 204, magnets 206, through holes 208, and screws 210. Base plate 180 has a cooperative shape and dimension so that housing assembly 20 mounts thereon with screws 210 that are inserted into posts 46. Magnets 206 are within holes 204.

Figure 3:
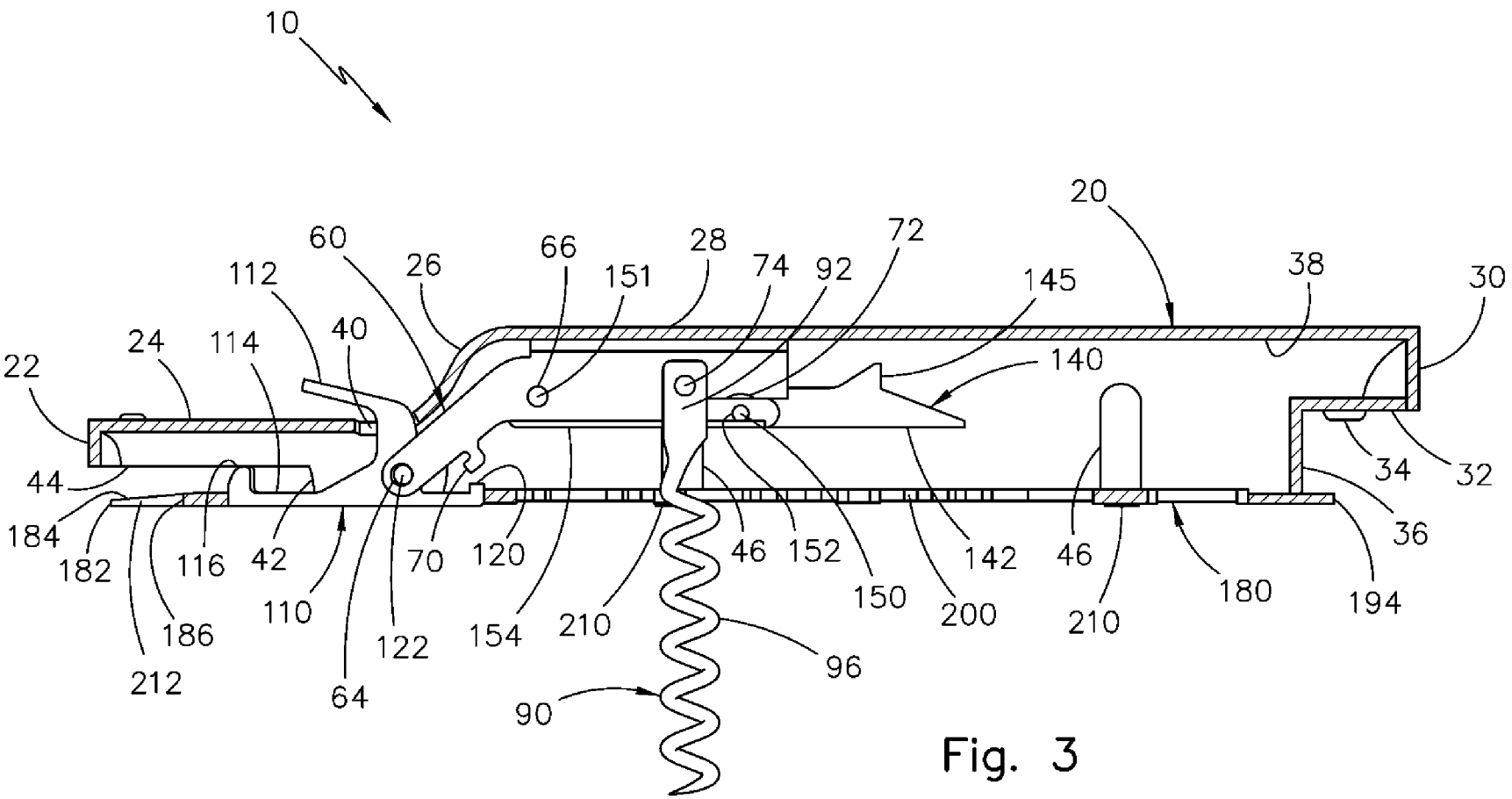
FIG. 3 is a longitudinal cross section view of the instant invention, taken along lines 3-3 as seen in FIG. 1, and further illustrating the corkscrew assembly in an extracted position.

As seen FIG. 3, corkscrew assembly 90 is in an extracted position. Corkscrew assembly 90 is pivotally mounted to frame assembly 60 with pin 74 inserted into hole 94 and hole 68 of frame assembly 60. When needed, a user can position corkscrew 96 from a retracted position into an extracted position, and vise versa.

Figure 3A:
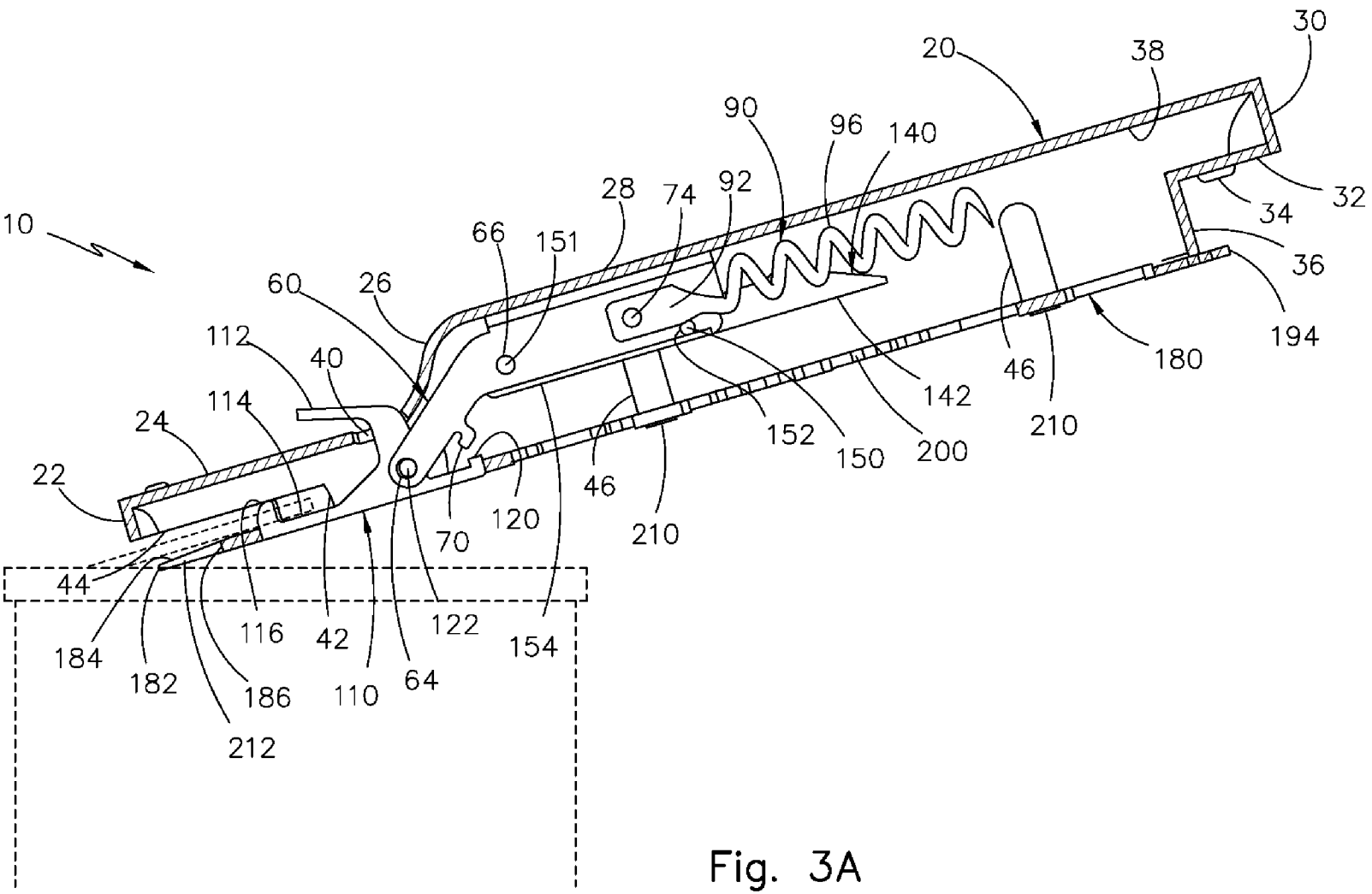
FIG. 3A is the longitudinal cross section view illustrated in FIG. 3, showing the instant invention mounted onto a top end of a can and lifting a retained cap in a first direction, and further illustrating the corkscrew assembly in a retracted position.

As seen in FIG. 3A, instant invention 10 is mounted onto a top end of a can. In the preferred embodiment, the can comprises a retained cap having a ring, a lid, and in most cases, a double seam. The can may contain any matter such as a beverage or food as an example. In operation to open a can of carbonated beverage having a permanent lid, such as a soda can for example, instant invention 10 is wedged onto the lid of the can, whereby front edges 182 are forced in a first direction in between the retained cap and the lid a predetermined distance, then retained cap is lifted in a first direction when a user positions instant invention 10 at a predetermined angle as seen in FIG. 3A. It is noted that intermediate end 42 has a thickness that defines an elongated channel when housing assembly 20 is mounted onto base plate 180, as seen in FIG. 1. The elongated channel receives any size retained cap or ring to enter it, regardless of its width.

Figure 3B:
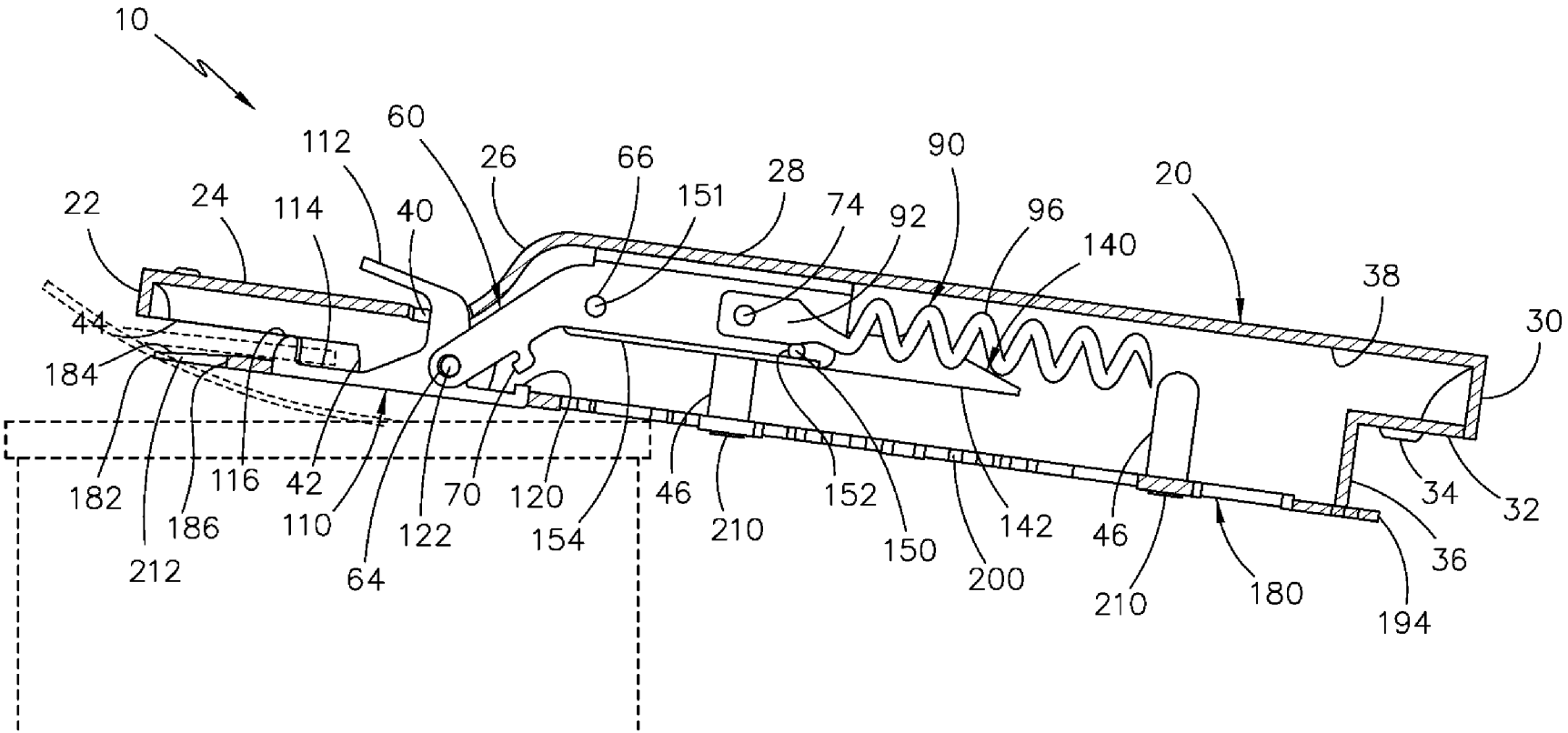
FIG. 3B is the longitudinal cross section view illustrated in FIG. 3, showing the instant invention mounted onto the top end of the can and lifting a lid of the can in a second direction.

In operation to open a small can of food having a removable lid, such as tuna can for example, instant invention 10 is wedged onto the lid of the can, whereby front edges 182 are forced in a first direction in between the retained cap and the lid, until lip 116 engages the ring of the retained cap. Once engaged, the retained cap is lifted in a first direction when a user positions instant invention 10 at a first angle as seen in FIG. 3A. Then the user positions instant invention 10 at a second angle, thus removing the lid from the top end of the can. It is noted that the user may optionally establish a fulcrum by placing instant invention 10 onto an edge of the double seam as seen in FIG. 3B. This operation is most effective when the width of the top end of the can is less than the total length of instant invention 10. To release the retained cap, the user applies a force onto trigger 112 to overcome a spring force of leaf spring 158.

In operation to open a large can, instant invention 10 is wedged onto the lid of the can, whereby front edge 182 is forced in a first direction in between the retained cap and the lid, until lip 116 engages the ring of the retained cap. Once engaged, the retained cap is lifted in a first direction when a user positions instant invention 10 at a predetermined angle as seen in FIG. 3A. Then the user extracts lever arm assembly 140 and places lip rest 145 onto the double seam. Then the user positions instant invention 10 at a second angle, thus removing the lid from the top end of the can. It is noted that the user establishes a fulcrum by placing lip rest 145 onto the double seam, not illustrated. This operation is most effective when the width of the top end of the can is greater than the total length of instant invention 10. To release the retained cap, the user applies a force onto trigger 112 to overcome a spring force of leaf spring 158.

Figure 4:
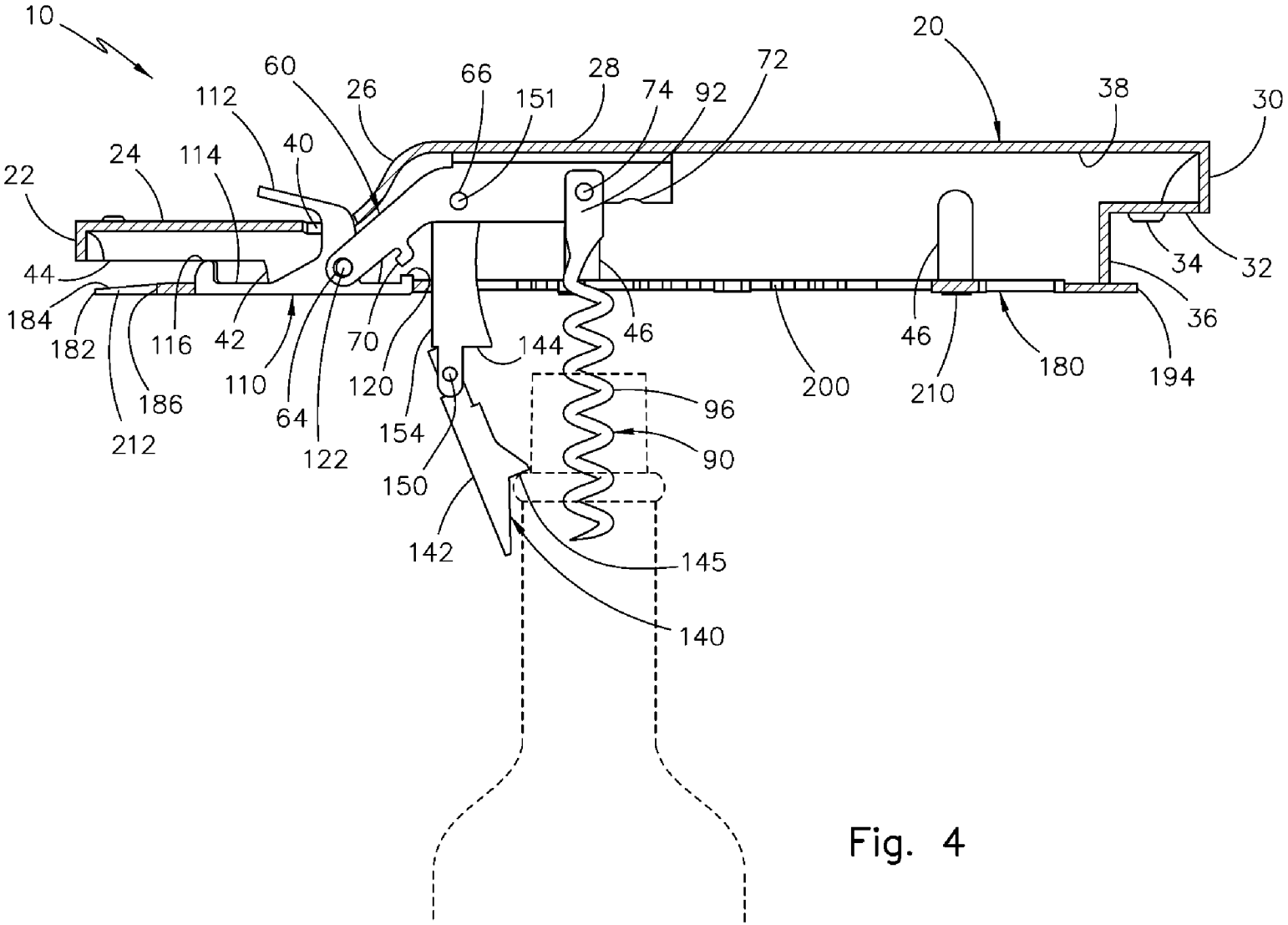
FIG. 4 is the longitudinal cross section view illustrated in FIG. 3, showing the instant invention mounted onto a top end of a bottle and illustrating lever arm assembly 140 in an extracted position, and further illustrating corkscrew assembly 90 in the extracted position and inserted into a cork.

As seen in FIG. 4, instant invention 10 is mounted onto a top end of a bottle having a cork. In the preferred embodiment, the bottle comprises a lip. The bottle may contain any matter such as wine or ("CHAMPAIGN") as an example. In operation to extract the cork from a bottle having the lip, lever arm assembly 140 and corkscrew assembly 90 are extracted from housing assembly 20. Corkscrew 96 is placed upon the cork and instant invention 10 is rotated until corkscrew 96 penetrates the cord a predetermined distance. Lip rests 144 may initially be placed upon the lip and used as a fulcrum. Lip rest 145 may then be used to finally extract the cork from the bottle.

Figure 5:
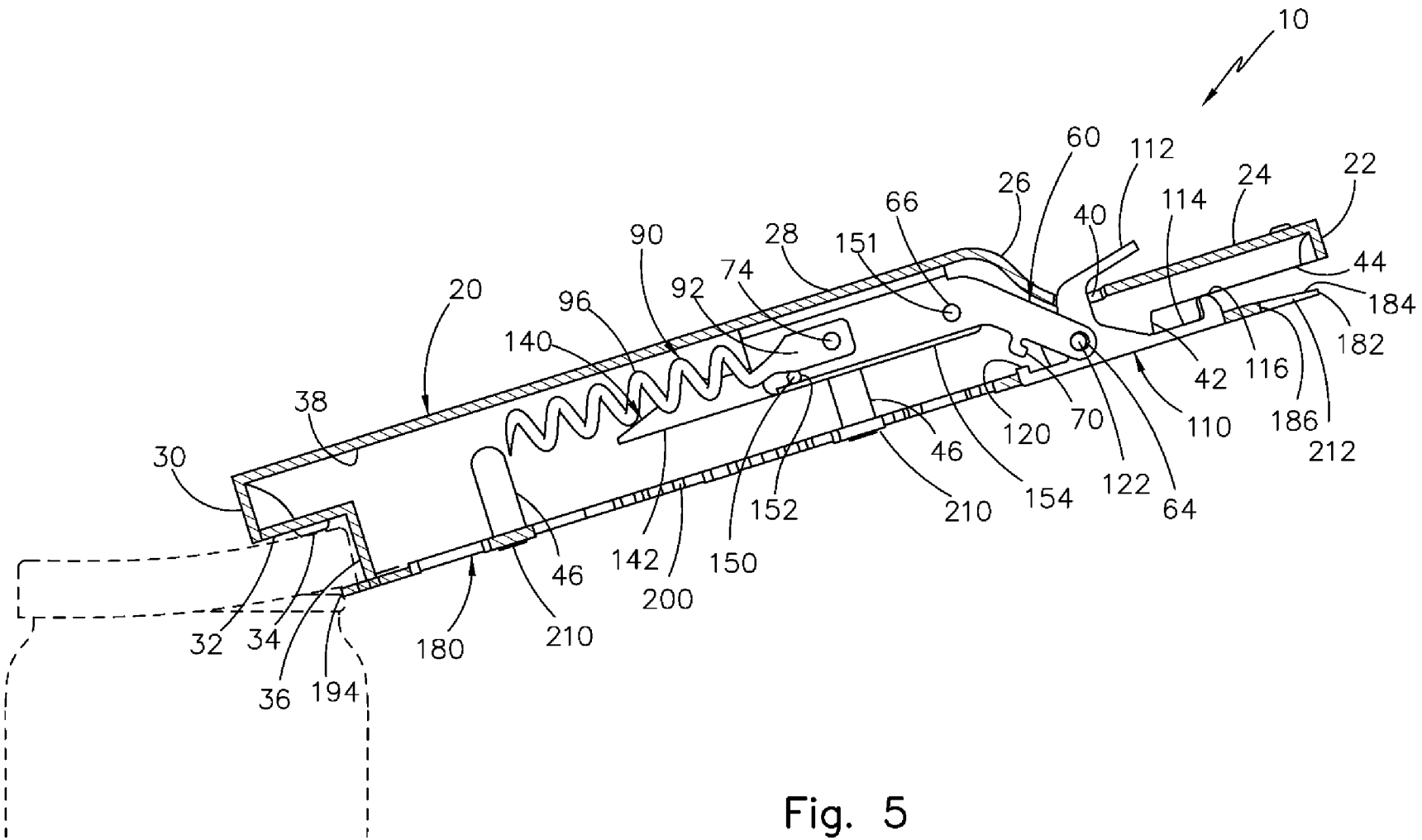
FIG. 5 is the longitudinal cross section view illustrated in FIG. 3, showing the instant invention mounted onto a top end of a jar and prying a cap therefrom.

As seen in FIG. 5, instant invention 10 is mounted onto a top end of a jar having a cap. The jar may contain any matter such as baby food as an example. In operation to pry the cap from the jar, protrusion 194 is wedged in between the cap and the jar, whereby the top of the cap will make contact with bushing 34 that is mounted on angled wall 32. Then instant invention 10 is raised at a predetermined angle to pry the cap off from the jar, as seen in this illustration.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An opener apparatus for a plurality of different containers, comprising a base plate having first and second front edges and first and second interior lateral edges extending respectively therefrom to an intermediate edge, said base plate further comprising first and second wedges extending a first predetermined distance from said first and second front edges respectively, said opener apparatus for a plurality of different containers further comprising a housing assembly, said housing assembly having first and second ends, defining an elongated channel extending from said first end a second predetermined distance without reaching said second end when said housing assembly is mounted onto said base plate, said opener apparatus for a plurality of different containers further comprising a frame assembly, said frame assembly mounted onto a first interior face of said housing assembly, said frame assembly comprising first and second arms, and said opener apparatus for a plurality of different containers further comprising a trigger assembly, said trigger assembly is pivotally mounted onto said frame assembly, said trigger assembly comprises a trigger, a catch arm having a first lip, a second lip, and a leaf spring.

2. The opener apparatus for a plurality of different containers set forth in claim 1, further characterized in that said housing assembly comprises an aperture.

3. The opener apparatus for a plurality of different containers set forth in claim 2, further characterized in that said trigger protrudes through said aperture.

4. The opener apparatus for a plurality of different containers set forth in claim 1, further characterized in that said housing assembly comprises a second interior face.

5. The opener apparatus for a plurality of different containers set forth in claim 4, further characterized in that said leaf spring causes said first lip, extending from said catch arm, to be biased against said second interior face.

6. The opener apparatus for a plurality of different containers set forth in claim 1, further comprising a lever arm assembly, said lever arm assembly is pivotally mounted onto said frame assembly, said lever arm assembly comprises first and second lever arms, said first lever arm is pivotally mounted onto said second lever arm.

7. The opener apparatus for a plurality of different containers set forth in claim 6, further characterized in that said first lever arm comprises a first lip rest, and said second lever arm comprises a second lip rest.

8. The opener apparatus for a plurality of different containers set forth in claim 1, further characterized in that said base plate comprises at least one semi-circular section, said at least one semi-circular section having jagged edges.

9. The opener apparatus for a plurality of different containers set forth in claim 1, further comprising a corkscrew assembly, said corkscrew assembly comprising an elongated torso having a hole, and a corkscrew, said corkscrew assembly pivotally mounted onto said frame assembly.

10. The opener apparatus for a plurality of different containers set forth in claim 1, further characterized in that said base plate comprises third and fourth ends.

11. The opener apparatus for a plurality of different containers set forth in claim 10, further characterized in that said first and second front edges are positioned at said third end, and said base plate further comprises an aperture positioned in between said third and fourth ends, and said base plate further comprises a protrusion at said fourth end.

12. An opener apparatus for a plurality of different containers, comprising:

A) a base plate having first and second front edges and first and second interior lateral edges extending respectively therefrom to an intermediate edge, said base plate further comprising first and second wedges extending a first predetermined distance from said first and second front edges respectively;

B) an elongated housing assembly, said elongated housing assembly having first and second ends, said elongated housing assembly defining an elongated channel extending from said first end a second predetermined distance without reaching said second end when mounted onto said base plate;

C) a frame assembly, said frame assembly mounted onto a first interior face of said elongated housing assembly, said frame assembly comprising first and second arms; and D) a trigger assembly, said trigger assembly is pivotally mounted onto said frame assembly, said trigger assembly comprises a trigger, a catch arm having a first lip, a second lip, and a leaf spring.

13. The opener apparatus for a plurality of different containers set forth in claim 12, further characterized in that said elongated housing assembly comprises a first aperture, and said trigger protrudes through said first aperture.

14. The opener apparatus for a plurality of different containers set forth in claim 13, further characterized in that said elongated housing assembly comprises a second interior face, and said leaf spring causes said first lip, extending from said catch arm, to be biased against said second interior face.

15. The opener apparatus for a plurality of different containers set forth in claim 14, further comprising a lever arm assembly, said lever arm assembly is pivotally mounted onto said frame assembly, said lever arm assembly comprises first and second lever arms, said first lever arm is pivotally mounted onto said second lever arm, said first lever arm comprises a first lip rest, and said second lever arm comprises a second lip rest.

16. The opener apparatus for a plurality of different containers set forth in claim 12, further characterized in that said base plate comprises at least one semi-circular section, said at least one semi-circular section having jagged edges, and further comprising a corkscrew assembly, said corkscrew assembly comprising an elongated torso having a hole, and a corkscrew, said corkscrew assembly pivotally mounted onto said frame assembly, said base plate comprises third and fourth ends, said first and second front edges are positioned at said third end, and said base plate further comprises a second aperture positioned in between said third and fourth ends, and said base plate further comprises a protrusion positioned at said fourth end.

* * * * *